United States Patent [19]

Greenward, Sr.

[11] Patent Number: 4,887,722

[45] Date of Patent: Dec. 19, 1989

[54] METHOD FOR BENEFICIATING BY CARBONACEOUS REFUSE

[76] Inventor: Edward H. Greenward, Sr., 92 Nancy La., McMurray, Pa. 15317

[21] Appl. No.: 131,820

[22] Filed: Dec. 11, 1987

[51] Int. Cl.[4] ..... B03B 1/02; B04C 7/00; B07B 9/00

[52] U.S. Cl. ..... 209/3; 209/11; 209/5; 241/23; 241/24

[58] Field of Search ..... 209/3, 5, 11, 133, 211, 209/144; 44/626, 622; 241/23, 24

[56] References Cited

U.S. PATENT DOCUMENTS

| | | | |
|---|---|---|---|
| 2,446,140 | 7/1948 | McGee | 209/11 |
| 2,617,529 | 11/1952 | McGehee | 209/11 |
| 3,288,282 | 11/1966 | Eveson | 209/11 |
| 3,349,912 | 10/1967 | Eveson | 209/11 |
| 4,029,572 | 6/1977 | Theodore | 209/11 |
| 4,447,319 | 5/1984 | Lazik | 209/11 |
| 4,495,710 | 1/1985 | Ottoson | 44/626 |
| 4,511,362 | 4/1985 | Ravindram | 44/625 |
| 4,574,045 | 3/1986 | Crossmore | 209/11 |

FOREIGN PATENT DOCUMENTS

| | | | |
|---|---|---|---|
| 180595 | 10/1983 | Japan | 44/627 |

*Primary Examiner*—David L. Lacey
*Assistant Examiner*—Thomas M. Lithgow
*Attorney, Agent, or Firm*—Clifford A. Poff

[57] ABSTRACT

A method for beneficiating a coal refuse feed stream which includes agglomerated carbonaceous and clay particles. The feed stream is rapidly heated to volatilize moisture. Heating is carried out in a manner to produce abrasive commutation and sub-divide particles by volatilizing the moisture. After deagglomerating the feed stream, the discreet particles essentially consisting of carbonaceous particles and clay particles are separated to form a plurality of differently sized classifications of granular particles. A carbonaceous particle fraction essentially comprised of granular particles having a particle size greater than about 2 microns is recovered to form one fraction and a minus 2 micron fraction is classified to separate particles from the component gas. In one embodiment, a dust laden gas fraction is treated in an air classifier to form a coarse particle fraction and a fine particle fraction. The recovered coarse particle fraction can be used as a carbonaceous fuel.

9 Claims, 2 Drawing Sheets

METHOD FOR BENEFICIATING BY CARBONACEOUS REFUSE

BACKGROUND OF THE INVENTION

1. Field of the Invention

This invention relates to a method for beneficiating a non-homogeneous agglomeration of coal refuse that include carbonaceous and clay particles having a natural affinity for retention of free water. More particularly, the present invention provides a method for beneficiating such particles by rapidly heating the coal refuse to vaporize and release free water and to subdivide the agglomeration forming the coal refuse so that classification procedures can be employed to derive a particle fraction having a Btu value suitable to form a low or clay free fuel supply.

2. Field of the Invention

While not so limited, the present invention can be used to provide a fuel supply for a heat generating combustor utilizing fluidized bed combustion technology which permits the use of fuel derived from many forms of waste materials having a residual heat value substantially lower than could be economically utilized in the past. According to the present state of the art, fluidized bed combustors can economically function with a fuel having a uniform heat value of as low as 3,000 Btu per pound. The solid waste stream generated by the operation of coal processing plant forms an abundant source of waste coal refuse fuel. Large surface deposits, often abandoned, occur due to the accumulation of coal refuse. The coal refuse is a reject remnant of coal processing plants with a high hourly through-put processing rate coupled with a multi-decade life span. Such accumulations can readily yield a fuel having a total usable heat value of a magnitude sufficient to meet the requirement for fueling a large fluidized-bed combustor. Such a combustor may be capable of supplying the energy necessary to generate 30 to 80 megawatts of electrical power throughout a useable life span of the generating facility. The deposits can be found where coal has been mined and prepared and therefore the deposits are generally widespread. A principle contaminant of carbonaceous deposits, particularly remnants from coal cleaning operations, occurs as rock formations composed principally of clay material of hydrus-alumina-silicate composition with a relatively uniform particle size in the range of 0.7 to 2 micrometers. The abundance of such clay material dispersed in the carbonaceous component of the refuse is not only widely varied but also a major component. Contributing rocks and/or minerals in a pure state with a high clay content are characterized by a dry ash content of more than 80 percent accompanied by a heat value of the refuse material of less than 1,500 Btu's per dry pound of refuse. The particles of rocks and minerals that are non-contributors to the usable heat include clay; shale, which may comprise clay shale or sandy shale; sand stone; lime stone and lime stone/calcite. Such rock/minerals are subject, through the slaking process, to disintegration and quickly pass from a en masse rock form into an agglomerated matri of individual grains capable of plastic flow. The present invention provides a process for effectively beneficiating refuse deposits having heretofore uncommercially recoverable amounts of carbonaceous components by utilizing the phenomena of the uniform particle size of the clay component.

In coal refuse deposits discussed hereinbefore, the average heat value of the deposits is a function of the combustible content of various forms of rock or mineral matter that constitute the total of the deposit. The average usable heat value is the aggregate of the calorific contributions due to the presence of particles of pure coal, pure coal/bone, carbonaceous shales and sulfur bearing minerals, such a pyrite and marcasite. For use as a fuel, the contribution must have a heating value in excess of 1,500 Btu's per dry pound thus the dry ash content less than 80 percent. On the other hand particles of rock or minerals that are non-contributors to useable heat value include clay, shale, sandstone and limestone or calcite which in their pure state are characterized by an ash content of more than 80 percent and an accompanying heat value of less than 1,500 Btu's per dry pound. At any given location in a coal refuse deposit the in situ heat value of a sample is a function of the quantitative distribution or ratio of heat contributing minerals to non-heat contributing minerals. The relativity of particle distribution is considerably, and therefore there is a wide variation to in situ heat values of refuse samples thereby variations to useable heat valve occur in any given coal refuse deposit.

The slaking/weathering process brings about an immediate and drastic alteration to the physical properties of freshly mined clays and clay shales upon placement of a reject product in a coal refuse site. Such freshly mined clay and clay shales are part of contributing and non-contributing rocks and minerals. In refuse coal deposits, platelets of clay occur within a size range of from about 0.7 to about 2 micrometers. Solid freshly mined clay is transformed by the slaking process from an identifiable rock having a weak compressive strength into a plastic mass with little bonding between the clay platelets and therefore capable of plastic flow. As the slaking process proceeds, the high clay content of the refuse pile is compressed due to the weight of the overlying material along with any compressive action due to wheeled vehicles used in the coal refuse placement process. Plastic flow of the micro particles of the clay is induced which brings about a partial or a total encasement or encapsulation of individual macro pieces of other minerals with the clay. The action effectively transforms the coal refuse from an unconsolidated or loose mass of individual particles at the time of placement to a semi-solidified matrix of sticky, agglomerated micro and macro particles having difficult material handling characteristics. As the depth of the high clay content coal refuse deposit increases, the surface moisture content decreases and the density increases. The surface moisture content will generally fall within a range from a maximum of about 15 percent to a minimum of about 5 percent by weight. The total density will vary from as low a minimum of about 90 up to in excess of 110 pounds per cubic foot. The dry density will vary from a minimum of about 80 up to and perhaps in excess of 100 pounds per cubic foot.

SUMMARY OF THE INVENTION

It is an object of the present invention to provide a method for beneficiating refuse material by separating carbonaceous refuse particles from clay particles so such that the carbonaceous material has a sufficient Btu value to sustain combustion and form a useful heat supply.

It is a further object of the present invention to provide a process for beneficiating refuse deposits derived from a coal processing operation.

More particularly, the present invention provides a method for beneficiating a non-homogenous agglomeration of particles essentially including carbonaceous and clay particles. The method includes the steps of heating a feed stream comprised of said non-homogenious agglomeration of particles to liberate free water therefrom, deagglomerating the heated feed stream to form discreet particles essentially including carbonaceous and clay particles, forming a plurality of granular particle fractions having different size classifications from the discreet particles, and recovering a carbonaceous particle fraction essentially comprised of granular particles having a particle size greater than about two microns.

Preferably, the granular particle fractions are formed by the products recovered from the operation of an air classifier. The present invention can be practiced by classifying a particle entrained gas fraction from the deagglomeration step to form an under-product comprised of solid particles and a dust laden gas fraction, treating a dust laden gas fraction in an air classifier to form a course particle fraction and a fine particle fraction, and recovering a coarse particle fraction for use as a carbonaceous fuel. In the preferred form, the present invention provides that non-carbonaceous rock having a higher specific gravity then carbonaceous particles is separated from the coarse fraction before use thereof as a carbonaceous fuel.

DESCRIPTION OF THE DRAWINGS

These features and advantages of the present invention as well as others will be more fully understood when the following description is read in light of the accompanying drawings in which.

DESCRIPTION OF THE PREFERRED EMBODIMENT

Figure 1:
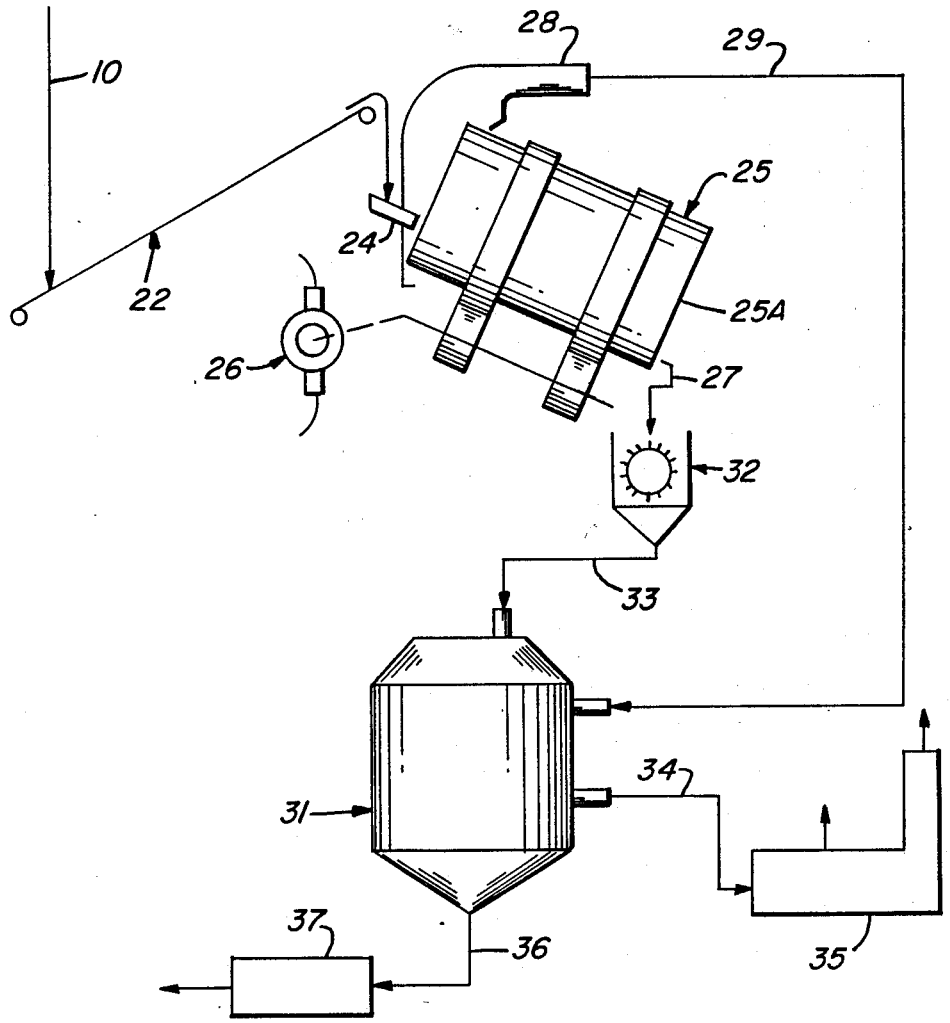
FIG. 1 is a schematic flow diagram of one arrangement of the apparatus to carryout the method of the present invention.

In FIG. 1 of the drawings, reference numeral 10 identifies a supply stream of carbonaceous material to undergo treatment according to the present invention for utilization as a waste fuel. The material of the supply stream may comprise sub-bituminous and bituminous coal refuse having a maximum particle size of 6" deposits having a high clay and/or high clay/shale content. In Table I given below there is exemplified the chemical characteristics of a bituminous coal refuse deposit derived from a test drilling exercise wherein the depth of the deposit was sampled at five (5) foot increments to a total of seventy (70) feet.

TABLE 1

| Item | Maximum | Minimum | Average |
|---|---|---|---|
| % Moisture | 8.99 | 4.22 | 6.57 |
| % Dry Ash | 71 | 58.45 | 70.72 |
| As Rec'd. BTU/lb | 4,294 | 2,021 | 2,766 |
| Dry Btu/lb. | 4,541 | 2,129 | 2,958 |
| MAF Btu/lb. | 12,139 | 8,740 | 9,929 |
| % Dry Sulfur | 3.03 | 1.09 | 1.95 |

The average moisture content computed from the maximum and minimum moisture content of test samplings renders the coal refuse particularly unsuitable as a fuel supply because a non-acceptable quantity of heat energy is necessary to vaporize the moisture from the particles of coal refuse. Moreover, in the coal refuse deposit slaking of the clay and shale components, along with an associated plastic flow, converts the originally loose unconsolidated coal refuse into a sticky, heterogeneous matrix made up of heat contributing and non-heat contributing rock/mineral particles that are assembled and occur in various in situ degrees of agglomeration. The coal refuse deposit in an in situ state has very poor handling and combustion characteristics and because of the high/clay content of the recovered coal refuse, the recovered mass will not continuously support combustion at a level required to form a useful heat source as a combustor fuel. The physical and chemical characteristics of the coal refuse deposit which significantly vary comprise (1) moisture content; (2) density; (3) in situ useable heat value; (4) ash content; (5) volatile content: (6) carbon content; (7) sulfur content; (8) quantitative and qualitative ratio of heat and non-heat contributing materials and; (9) discrete particle and/or grain including minerology, particle size distribution, and mass/-specific gravity. Each of these factors are significant to the handling and combustion in characteristics of the material as recovered from a refuse deposit. Most sub-bituminous and bituminous coal refuse deposits comprise a material which will not yield a feedstock for a burning process to produce useable heat without supplemental fuel on a continuous basis or without some other form of preconditioning and/or beneficiation. One important aspect of the present invention is the improved handling and combustion characteristics of in situ refuse material by conversion into a product having necessary characteristics of uniformality so that the product can be handled, fired and combusted with optimum thermal results. Important to the realization to this result is the elimination of non-heat contributors in the combustion process. Surface and bound moisture are examples of non-heat contributors. When required, blending of the products recovered from the beneficiation process of the present invention can be used to produce uniform physical and chemical characteristics of the fuel material.

The carbonaceous fuel supply derived from the process of the present invention can be utilized to meet the requirements for combustion in a fluidized bed combustor designed to burn sub-bituminous and/or bituminous refuse material. The fuel supply for such as fluid bed combustor permits a particle size distribution with a plus $\frac{1}{4}$ inch material making up not more than 10 percent of the fuel up to a maximum size of $\frac{3}{8}$ inch. A minus 200 mesh size fraction can comprise no more than 5 percent of the fuel particles. The maximum surface moisture of the fuel can be seven (7) percent and the average heat value should be at least four thousand (4,000) Btu's per pound with a minimum of not less than 3,400 Btu's per pound for any given fifteen minute firing period provided the loss of Btu is not to moisture. The particle size distribution is important because an excess of minus 200 mesh (74, um) ultra fines impedes the flow of combustion gases through the fluidized bed whereas an excess of oversized particles reduces the rate of combustion and interferes with the reaction of limestone with sulfur bearing minerals in the fluidized bed used to control SO emissions.

In FIG. 1 of the drawings, the arrangement of apparatus provides that the raw coal refuse in line 10 is carried by conveyor 22 for discharge by a trough 24 into a rotary dryer 25 at the elevated input end. The particles are heated rapidly as they pass downwardly along a parallel flow dryer which is rotatably supported and rotated by a drive system 26 so that the particles in the supply stream are stirred while passing along the dryer to maximize the heat input. As the particles pass along the rotary dryer towards the discharge end 25A, the particles are rapidly heated to a temperature of, generally between the range of 350 degrees to 400 degrees F. Attrition resulting in deagglomeration of the lump of feedstock occur by tumbling induced by lifting plows, chains, etc. in the dryer chamber and the declining attitude of the dryer chamber. Immediately upon introduction to the dryer chamber, the particles are exposed to intense heat in a chamber atmosphere that can be as high as 1200 degrees F. The residance time of the feedstock in the dryer chamber is short and controllable by the rational speed of the dryer so as to avoid depletion as by combustion of material or significant amounts of the carbonecous or other heat producing constituent of the feedstock. The dryer is heated by an external fuel supply. The heating is sufficiently rapid so as to vaporize any moisture commonly associated with the clay constitute of the particles. The rapid vaporization of water voltizes the expanding vapor to subdivide clay particles from an agglomerate of clay and carbonaceous particles and thus effectively reduce the particle size and especially dislodging clay platelets which have a particle size in the range of 0.7 to 2, um as a particulate distributed in and borne by the discharge stream in line 29.

A significant underlying factor in the present invention, is that any clay content of the coal refuse deposit is composed of individual platelets of clay having discrete particles size generally within the range of 2 microns or less. Each clay platelet is surrounded by a water film with a thickness of the order of magnitude of the platelet thickness. The volume of such a particle is approximately two thirds water so that the specific gravity of the clay platelet with entrained water approaches 1.8 as opposed to a conventional value of normally between 2.7 and 2.8. The clay platelet has an atomic structure that includes a layer of ions, a substantial portion of which are hydroxal ions. The hydroxal ions constitute bound water and may comprise up to between 15 and 18 percent of the total weight of the clay particles. It can be therefore seen that should the clay platelet comprise part of the carbonaceous fuel, the bound water flashes in the combustion process and therefore constitutes a large consumer of Btu's which can be derived only from the combustion process. For this reason, the hydrated clay platelets constitute a non-heat contributor of the highest order. According to the present invention, the feedstock from a high clay content coal refuse deposit is first dried and then abrasively commuted by tumbling preferably in the rotary drier under conditions which also flash heat the particles so that the heat input volitized the water content at a sufficiently rapid rate to subdivide the particle once and perhaps many times so that a significant portion of the clay platelets become discrete particles and can be removed by subsequent classification. In this process, ultra-fine particles of sulfur bearing minerals of similar size also occur. Once the feedstock is the devoid of clay, the balance of the feedstock, which is dry, can be subjected to a treatment to further eliminate high ash content and other non-heat contributors from the beneficiation process.

An air laden particle fraction collects in a hood 28 with exhaust air at the upper end of the rotary dryer 25. The air laden particle fraction, includes particles within a −8 mesh particle size which are conveyed by line 29 to a air classifier 31.

A dried granular residue product in a discharge line 27 is treated in a impactor 32 to reduce the particle size to a ¼ by 0 fraction. This product is then delivered by line 33 to an air classifier 31. The air classifier separates the particulate inputs into a particle fraction mainly comprised of clay platelets and delivered by line 34 to a bag house 35 where the particles can be separated from the exhaust air by filters. The residual gases are discharged to the atmosphere by an appropriate stack. The second divided fraction from the air classifier is delivered by line 36 to, for example, a storage bin 37. Typically, this fraction is comprised of a ¼″×40 um particles having a sufficiently high Btu value for use as a carbonaceous feedstock for a combustion process. Depending, of course, on the type of combustion process, it may be desirable to deliver a particle fraction from the air classifier to a chamber wherein only an air entrained −2 um particle fraction comprised of essentially only clay particles is separated from the remaining carbonaceous particles.

Figure 2:
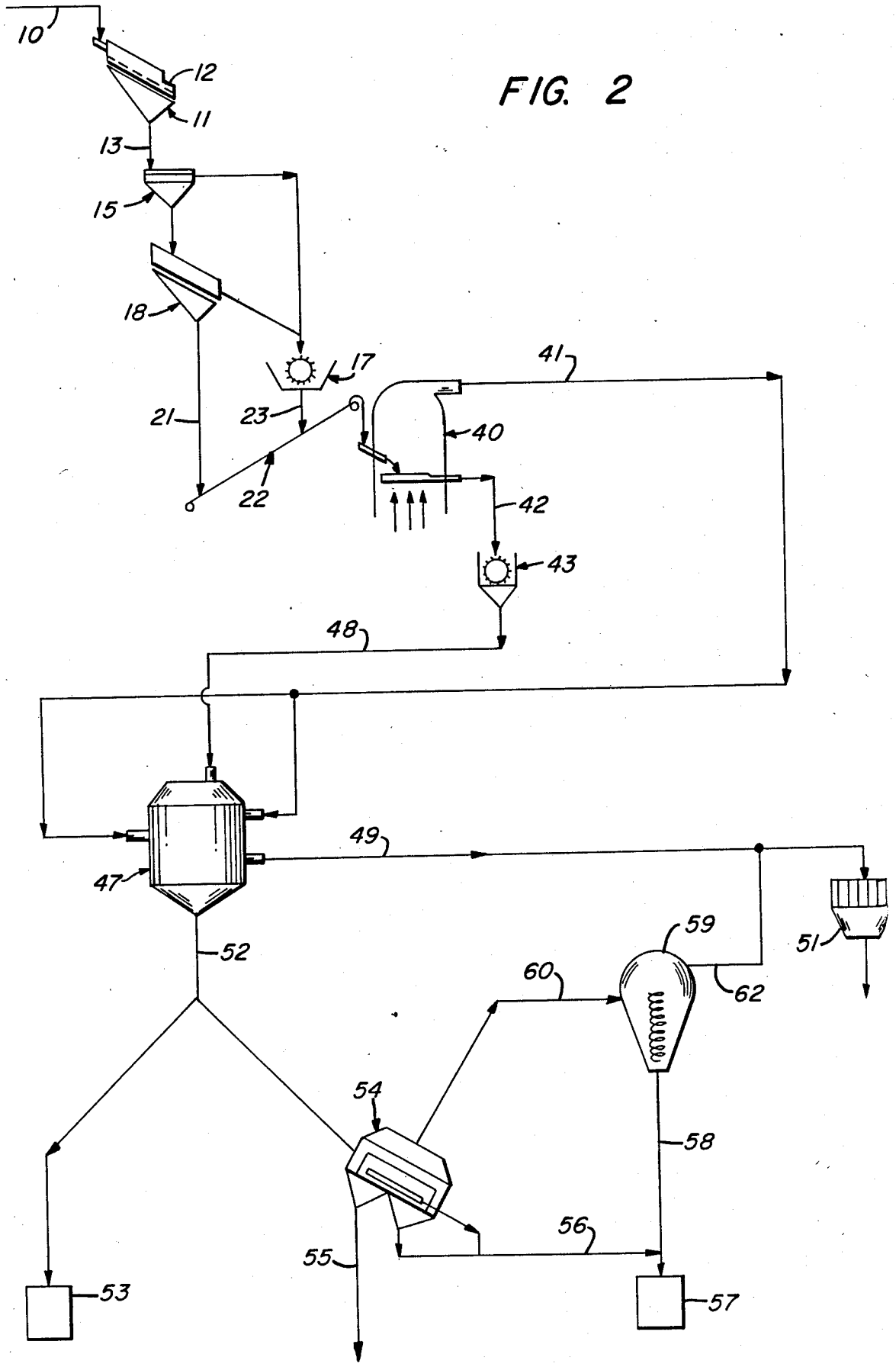
FIG. 2 is a schematic flow diagram of a second arrangement of apparatus to carry out the present invention.

A second embodiment of the present invention can be practiced by the arrangement of the apparatus shown in FIG. 2 for beneficiating refuse deposits of carbonaceous material. The fuel supply in line 10 can be processed and transported in a manner per se well known in the art to provide a suitable supply of feedstock. In the arrangement of apparatus shown in FIG. 2 like the embodiment of FIG. 1, the particles in line 10 are processed on a dump hopper 11 having separation grid 12 which allows a 6 by 0 fraction to pass into the hopper for discharge by line 13 and a plus 6 fraction can be recovered from the grid for processed in a crusher or other suitable machinery to reduce the particle size down to a fraction which can be returned to the hopper 11. The under-slow from the dump hopper is fed by line 13 to a classifier 15 whereby a 3″ by 0 fraction is recovered as an underflow while a top product comprising a 3″ by 6″ fraction is delivered to a crusher 17. The under-flow from the classifier 15 is deposited onto a classifier 18 and the top product, a plus 1½″ fraction is discharged by line 21 to the crusher 17 while the under-product from the classifier 18 made up of a 1½″×0 fraction is discharged by line 21 to feed conveyor 22. The commutated product from the crusher 178 is made up of particles essentially 1½″×0. This is a function of controlling the crusher to subdivide the feedstock received from classifiers 15 and 18. The subdivided product delivered from the crusher passes by line 23 onto the conveyor 22. The conveyor delivers the fraction to a fluidized bed classifier 40.

The abrasive action in the fluid bed classifier coupled with the rapid thermal input to the feedstock drives off surface moisture in a way that results in deagglomeration of the particles. The amount of abrasive action and attended commutation is a function of the depth of the fluidized bed and the retention time of the feedstock in the bed. From the fluidized bed there is recovered two product stream one comprised of exhaust air including water vapor and an entrained particle fraction made up of particles of less than 8 mesh (280 micrometer) in line 41. A solid granular fraction 1½×8 mesh is delivered from classifier 40 by line 42 to a impactor 43.

The product delivered by line 41 is carried to an air classifier 47 which also receives commutated product in line 48 from impactor 43.

On fraction from the air classifier 47 preferably a minus 40 micron fraction, can be discharged by line 49 to a bag house 51 for collecting the dust from the exhaust air. The second fraction from the air classifier preferably comprised of a $\frac{1}{4}'' \times 40$ micrometer fraction particles is discharged by al line 52 to a storage bin 53 and/or to an air cleaner 54. The larger particles made up of rock of plus 8 mesh are discarded from the air cleaner by line 55. This discard can be returned to the air classifier after commutation to separate clay from the constitute of the carbonaceous particles.

A second classified product recovered from the air cleaner is carried by line 56 and comprises a plus 2 micron fraction which is delivered to a storage bin 57 for use as a carbonaceous fuel supply. The storage bin also receives a particle fraction as an under-product from line 58 from a cyclone air cleaner 59. The cyclone receives a particle fraction from line 60 comprised of a gaseous entrained fraction recovered from air cleaner 54. The over-product recovered from air cleaner cyclone 59 is discharged by line 62 to join with the minus 40 micron particles in line 49 for treatment in the bag house 51.

While the present invention has been described in connection with the preferred embodiment shown in various figures, it is to be understood that similar embodiments may be used or modifications and additions may be made to the described embodiment for performing the same functions of the invention without deviating therefrom. Therefore, the present invention should not be limited to any single embodiment, but rather construed in breadth and scope in accordance with the recitation of the appended claims.

What I claim is:

1. A method for beneficiating carbonaceous particles from a feed stream comprising an agglomeration of carbonaceous particles, clay particles and water, said method including the steps of:

heating said feed stream comprised of said agglomeration of particles sufficient to volatilize the water from the feedstream, including the agglomeration of particles, and simultaneously agitating the feedstream in an amount sufficient to deagglomerate the heated agglomeration of particles to form discrete particles consisting essentially of carbonaceous particles with a particle size of generally plus two microns and clay particles with a particle size of generally minus two microns;

separating the heated deagglomerated feed stream, including said discrete particles, into a plurality of granular particle fractions have different size classifications, said fractions including a generally plus two micron carbonaceous particle fraction and a generally minus two micron clay particle fraction;

recovering said generally plus two micron carbonaceous particle fraction; and recovering said generally minus two micron clay particle fraction.

2. The method according to claim 1 wherein the separating of the deagglomerated heated feed stream into the plurality of granular particle.fractions is performed by an air classifier.

3. The method according to claim 1 wherein said step of heating and agitating includes feeding the agglomeration of particles to a rotary heater.

4. The method according to claim 1 wherein said heating and agitating includes feeding the agglomeration of particles into a fluidized bed classifier.

5. The method according to claim 1 wherein said step of separating includes subjecting the heated deagglomerated feed stream to classification in at least one air classifier to form a first product comprised of solid particles having a size of about plus eight mesh and a second product comprised of a dust laden gas fraction;

treating said dust laden gas fraction in an air classifier to form a coarse particle fraction and a fine particle fraction; and recovering said coarse particle fraction for use as a carbonaceous fuel.

6. The method according to claim 1 wherein said heating is carried out at a rate sufficient to separate clay particles from carbonaceous particles by expansion of entrapped volatilized water.

7. The method according to claim 1 wherein said deagglomerating includes abrasive commutation of the agglomerate particles.

8. A method for beneficiating a feed stream comprising a non-homogenous agglomeration of particles consisting essentially of carbonaceous particles, clay particles, and water said method including the steps of:

drying a feed stream comprised of said agglomeration of particles by heating said feed stream sufficient to liberate said water from said feed stream, including said agglomeration of particles, and simultaneously agitating said feed stream sufficient to deagglomerate the dried agglomeration of particles to form discrete particles consisting essentially of carbonaceous particles with a particle size of generally plus two microns and clay particles having a particle size of generally minus two microns; and separating said heated deagglomerated feed stream, including said discrete particles into plurality of granular particle fractions having different size classifications; one of said particle fractions consisting essentially of carbonaceous particles having a particle size of generally plus two microns and a second of said particle fractions consisting essentially of a generally minus 2 micron fraction of said clay particles.

9. A method for beneficiating a feed stream essentially including agglomerates consisting essentially of carbonaceous particles, clay particles and water, said method including the steps of:

heating the feed stream in an amount sufficient to liberate the water from said feed stream, including said agglomerates, and simultaneously agitating the feed stream to deagglomerate the heated agglomerates to form discrete particles essentially consisting of carbonaceous particles having a particle size of generally plus two microns and clay particles having a particle size of generally minus two microns;

separating said heated deagglomerated feed stream, including said discrete particles, to form a plurality of different size classifications of granular particle fractions, said fractions comprise a generally plus two micron carbonaceous particle fraction and a generally minus two micron clay particle fraction;

recovering said generally plus two micron carbonaceous particle fraction;

said separating comprises subjecting the heated deagglomerated feed stream to classification in at least one air classifier to form a first fraction comprised of solid particles having a size of about plus eight mesh and a second fraction comprised of a dust laden gas fraction;

treating the dust laden gas fraction in another air classifier to form a coarse particle fraction and a fine particle fraction; and recovering said coarse particle fraction for use as a carbonaceous fuel.

* * * * *